US010995456B2

(12) United States Patent
Fanucci et al.

(10) Patent No.: US 10,995,456 B2
(45) Date of Patent: May 4, 2021

(54) MODULAR ROUNDABOUT SYSTEM WITH INTERCONNECTABLE BOARDS

(71) Applicant: ZKxKZ, LLC, Lexington, MA (US)

(72) Inventors: Jerome P. Fanucci, Lexington, MA (US); Adam Lanik, San Diego, CA (US)

(73) Assignee: ZKxKZ, LLC, Lexington, MA (US)

( * ) Notice: Subject to any disclaimer, the term of this patent is extended or adjusted under 35 U.S.C. 154(b) by 67 days.

(21) Appl. No.: 16/569,802

(22) Filed: Sep. 13, 2019

(65) Prior Publication Data

US 2020/0087867 A1 Mar. 19, 2020

Related U.S. Application Data

(60) Provisional application No. 62/730,732, filed on Sep. 13, 2018.

(51) Int. Cl.
*E01C 1/00* (2006.01)
*E01C 1/02* (2006.01)
*E01C 11/02* (2006.01)

(52) U.S. Cl.
CPC ..... *E01C 1/02* (2013.01); *E01C 11/02* (2013.01)

(58) Field of Classification Search
CPC ..... E01C 1/02; E01C 11/02
USPC ..... 404/1, 72, 75
See application file for complete search history.

(56) References Cited

U.S. PATENT DOCUMENTS 4,679,363 A * 7/1987 Adams ..... E04H 1/00 52/169.3
4,697,294 A 10/1987 Schafer
5,170,606 A 12/1992 Popp
5,286,136 A 2/1994 Mandish et al.
5,490,365 A 2/1996 Roth
6,718,588 B1 4/2004 Frederiksen
6,993,801 B2 2/2006 Marko et al.
7,591,605 B2 9/2009 Jonasz et al.
7,594,778 B2 9/2009 Baranoff
(Continued)

FOREIGN PATENT DOCUMENTS

AU 2009208047 A1 2/2011
DE 10118012 A1 10/2002
(Continued)

OTHER PUBLICATIONS

RTL, "Rubber Roundabouts", Jan. 22, 2015, http://rtl.co.nz/c/Car-Park-Solutions-Traffic-Calming/p/829/Rubber-Roundabouts.aspx (Year: 2015).
(Continued)

*Primary Examiner* — Raymond W Addie
(74) *Attorney, Agent, or Firm* — Verrill Dana, LLP

(57) ABSTRACT

A modular roundabout or traffic calming system with interlocking connectors and a method of installation utilize a plurality of boards arranged in a pattern on a ground surface at an intersection of vehicle roadways, the pattern including one or both of a central island and a splitter island. At least some of the boards forming a perimeter of the pattern are affixed to the ground surface. At least some of the boards forming interior boards are interconnected at adjacent edges with connectors. The connectors can include a hinge joint so that the interconnected boards can be folded or rolled. A kit for a modular roundabout or traffic calming system is also provided.

20 Claims, 17 Drawing Sheets

(56) References Cited

U.S. PATENT DOCUMENTS

| | | | | |
|---|---|---|---|---|
| 8,388,261 | B1 | 3/2013 | Lane | |
| D722,084 | S | 2/2015 | Lane | |
| 9,908,692 | B2 | 3/2018 | Corbin | |
| 2002/0076276 | A1* | 6/2002 | Troemel | E01C 1/02 404/1 |
| 2006/0245828 | A1 | 11/2006 | Jonasz et al. | |
| 2014/0270938 | A1 | 9/2014 | Main et al. | |
| 2014/0270946 | A1* | 9/2014 | Bradsen | E01C 5/005 404/40 |
| 2016/0326873 | A1 | 11/2016 | Skogseth et al. | |
| 2019/0040589 | A1* | 2/2019 | Fanucci | E01C 11/221 |

FOREIGN PATENT DOCUMENTS

| | | | |
|---|---|---|---|
| DE | 102004020101 | A1 | 11/2004 |
| DE | 202009002775 | U1 | 7/2009 |
| EP | 1199408 | A1 | 4/2002 |
| GB | 2310235 | A | 8/1997 |
| KR | 101253691 | B1 | 4/2013 |
| NL | 1017945 | C2 | 10/2002 |

OTHER PUBLICATIONS

"Roundabouts", Traffic Calming Australia (2009), retrieved from http://www.tcaaustralia.com.au/roundabout.html on Aug. 16, 2016.
Traffic Calming Australia catalog, (2009), retrieved from http://www.tcaaustralia.com.au/catalogue.html on Aug. 16, 2016.
"Roundabout Added to Busy Annandale Intersection", E. Leayman, Jun. 12, 2018, Annandale, VA Patch, available at http://patch.com/virginia/annandale/amp/27620375/roundabout-added-to-busy-annandale-intersection.

* cited by examiner

Modular Mini-Roundabout
CAD Model

MODULAR ROUNDABOUT SYSTEM WITH INTERCONNECTABLE BOARDS

CROSS REFERENCE TO RELATED APPLICATIONS

This application claims the benefit under 35 U.S.C. § 119(e) of U.S. Provisional Application No. 62/730,732, filed Sep. 13, 2018, entitled "Modular Roundabout System with Interconnectable Boards," the disclosure of which is incorporated by reference herein.

STATEMENT REGARDING FEDERALLY SPONSORED RESEARCH OR DEVELOPMENT

N/A

BACKGROUND

A traffic roundabout (also termed traffic circle or rotary) is a central island located at the intersection of several vehicle roadways around which vehicles entering from the roadways flow in a circular pattern. Roundabouts offer several benefits to traffic flow. Traffic congestion can be reduced compared to all-way-stop-sign and traffic light-controlled intersections. The speed of approaching vehicles can be reduced, providing gaps for entry of minor-road traffic.

Miniature roundabouts (mini-roundabouts) are characterized by a small diameter central circle with traversable central and splitter islands. Mini-roundabouts can double traffic-handling capacity compared to 4-way stop sign control. They can cost less than larger roundabouts by eliminating land purchase or utility/drainage relocation. Mini-roundabouts can result in greater safety for drivers, pedestrians, and bicyclists. They offer most of the benefits of larger diameter, non-traversable roundabouts with the added advantages of smaller footprint and lower cost, making them attractive improvements for many two- and three-lane intersections.

A modular block system for miniature roundabouts is described in WO 2017/044734, published Mar. 16, 2017.

SUMMARY

Modular roundabout and traffic calming systems with interconnectable boards and methods of installation are provided.

In some embodiments, a modular roundabout or traffic calming system for vehicular traffic can include a plurality of boards arranged in a pattern on a ground surface at an intersection of vehicle roadways. In some embodiments, the boards can include a first perimeter portion of the plurality of the boards comprising perimeter boards arranged to form a perimeter of the pattern, at least some of the perimeter boards affixed to the ground surface. The boards can further include a second interior portion of the plurality of the boards comprising interior boards arranged inwardly from the perimeter boards to form an interior of the pattern. A plurality of connectors can be attached at adjacent edges of at least a portion of the interior boards to interconnect adjacent ones of the plurality of boards. In some embodiments, the pattern for the modular roundabout or traffic calming system for vehicular traffic can include a central island and one or more splitter islands.

In some embodiments, the connector can include a first portion connectable to a surface of a first board and a second portion connectable to a surface of a second board. Each connector can include a flexible hinge joint between the first portion and the second portion, such that adjacent ones of the boards interconnected by the connector can be folded at the hinge joint. In some embodiments, a plurality of the interior boards are interconnected together to form at least a section of the roundabout system, such that the section of the interior boards can be folded or rolled at each hinge joint. In some embodiments, each connector can include a spacer depending from the hinge joint between each interior board and an adjacent board. In some embodiments, the connectors can be recessed into correspondingly shaped recesses formed in the surfaces of the boards.

In some embodiments, at least a further portion of the interior boards that are interconnected with the connectors are not affixed to the ground surface.

In some embodiments, a plurality of ground anchors can be used to affix at least a portion of the boards to the ground surface. Each ground anchor can include an anchor cemented or grouted in a hole in the ground below an associated one of the boards, a bolt or screw extending through an opening in the associated board into the anchor, and a plug disposed within the opening in the associated board. In some embodiments, each plug can have a configuration chosen from a mushroom configuration, a wedge configuration disposed within a wedge-shaped opening, and a configuration disposed within a counterbore in the opening, and a configuration disposed with a countersink in the opening.

A method of installation of a roundabout or traffic calming system can be provided. In some embodiments, a method of making a roundabout can include providing a modular roundabout system as described herein, and installing boards of the roundabout system in a pattern on the ground surface at the intersection of vehicle roadways. The step of providing the modular roundabout system can include interconnecting at least a portion of the interior boards together via ones of the connectors to form at least a section of the roundabout system, and rolling the section up for transportation. The step of installing the boards in the pattern on the ground surface includes unrolling the section on the ground surface.

In some embodiments, the step of interconnecting the interior boards together can include interconnecting radially adjacent interior boards with the connectors, and the step of installing the boards in the pattern on the ground surface includes interconnecting circumferentially adjacent interior boards with the connectors.

In some embodiments, a method of installing a roundabout can include providing a modular roundabout system of perimeter and interior boards and connectors, affixing the perimeter boards in a pattern to a ground surface at an intersection of vehicle roadways, and interconnecting at least a portion of the interior boards to adjacent ones of the plurality of boards with the plurality of connectors.

In some embodiments, a method can further include, prior to affixing the perimeter boards to the ground surface, attaching one of the perimeter boards and a portion of the interior boards together via ones of the connectors to form at least a section, such as of a wedge, rectangle, or other shape; rolling the section up for transportation; and unrolling the section on the ground surface. In some embodiments, a method of installation of a modular roundabout or traffic calming system for vehicular traffic can include installing a central island and one or more splitter islands.

A modular roundabout or traffic calming kit can be provided. In some embodiments, a kit can include a plurality of boards configured to be disposed in a pattern on a ground surface at an intersection of vehicle roadways. A first perimeter portion of the plurality of the boards comprising perimeter boards can be configured to form a perimeter of the pattern, at least some of the perimeter boards affixable to the ground surface. A second interior portion of the plurality of the boards can include interior boards configured to form an interior of the pattern. A plurality of connectors attachable to edges of at least a portion of the interior boards to interconnect adjacent ones of the interior boards. A plurality of ground anchors to affix at least some of the perimeter boards to the ground surface. Instructions for installation at the ground surface can be included.

In some embodiments, a modular roundabout or traffic calming kit can include a plurality of boards configured to be disposed in a generally circular roundabout or other pattern on a ground surface at an intersection of vehicle roadways. The kit can include a first perimeter portion of the plurality of the boards comprising perimeter boards configured to form segments of a perimeter of the roundabout, the perimeter boards affixable to the ground surface, and a second interior portion of the plurality of the boards comprising interior boards configured to form an interior of the roundabout. The kit can include a plurality of interior and perimeter boards for other patterns, such as a splitter island. A plurality of connectors can be provided that are attachable to surfaces of at least a portion of the interior boards to interconnect adjacent interior boards. A plurality of ground anchors can be provided to affix the perimeter boards and optionally selected interior boards to the ground surface. Instructions for installation at the ground surface can be included.

DESCRIPTION OF THE DRAWINGS

Reference is made to the following detailed description taken in conjunction with the accompanying drawings in which.

DETAILED DESCRIPTION

Figure 1:
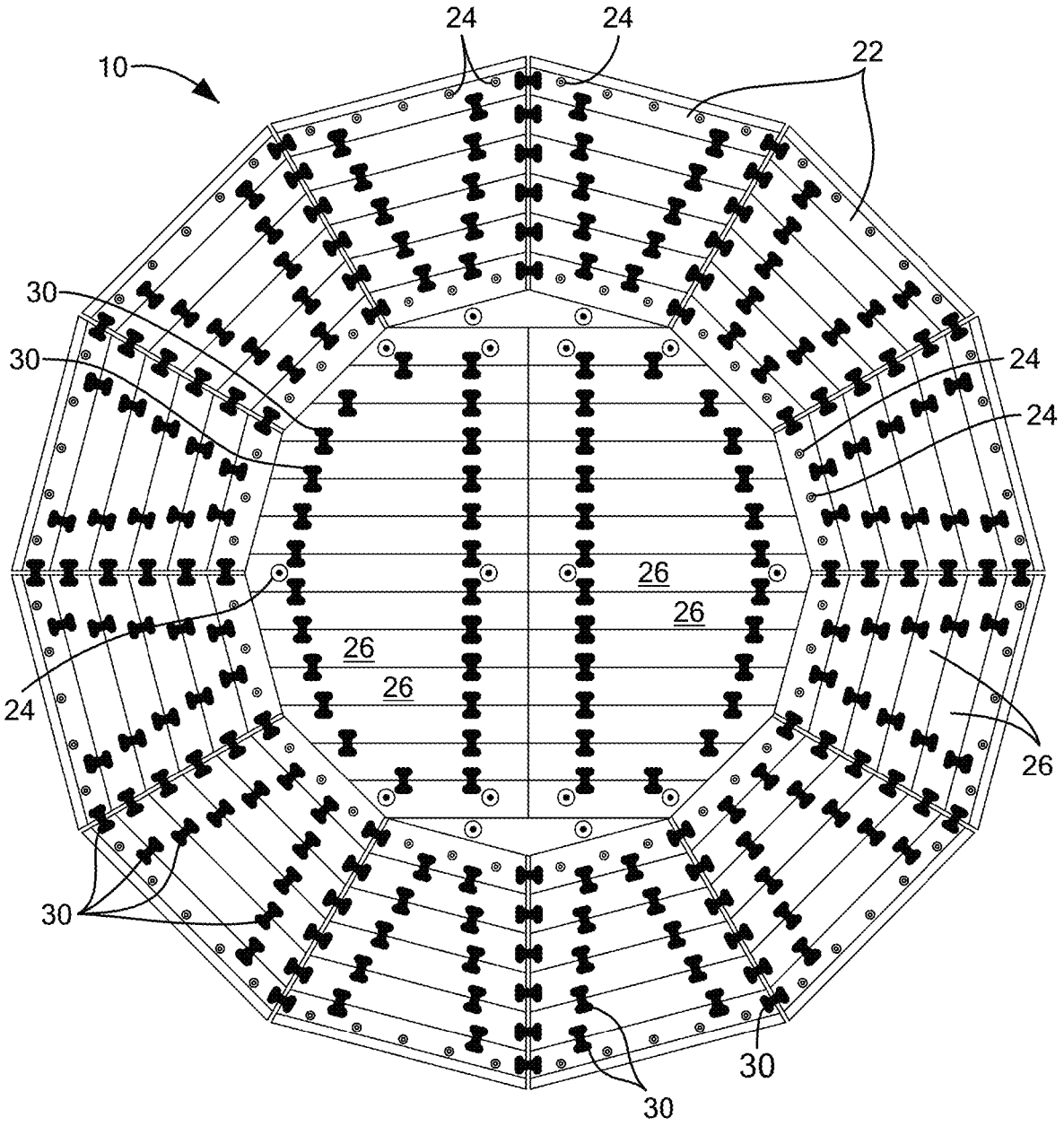
FIG. 1 is a schematic illustration of an embodiment of a modular roundabout system with interlocking connectors.

A modular roundabout or traffic calming system 10 with interconnectable modular boards or blocks and methods of installation are provided. Embodiments of a roundabout system can employ a plurality of modular blocks or boards arranged in a generally circular roundabout pattern or other pattern and affixed to a roadway or other ground surface at an intersection of vehicle roadways. More particularly, boards or blocks that form a perimeter of the roundabout, termed perimeter boards 22, can be affixed to the ground surface, for example, with ground anchors 24 or another fastening mechanism. Boards or blocks located in the interior within the perimeter, termed interior or filler boards 26, can be affixed to adjacent boards or blocks with one or more interlocking connectors 30. A portion or all of the boards or blocks in the interior are not, or need not be, affixed to the ground surface with ground anchors or another fastening mechanism.

By way of further explanation, in known modular roundabout systems, such as those described in WO 2017/044734 (incorporated herein by reference), all of the boards, perimeter and filler, are fastened to the ground surface. Such systems use two to four anchors per board to hold boards into place. The number of boards in such roundabouts can range from about 12 to about 10,000 boards. This results in a significant number of anchors. The anchor installation process can be the most time-consuming portion of the installation process.

In known modular roundabout systems, the perimeter boards are typically attached directly to the ground with two to four anchors. Because they are on the outside of the islands and see higher levels of lateral loading from vehicles that graze or traverse these boards, they are inherently impacted more frequently and severely. The filler boards are attached directly to the ground surface with two anchors. They see significantly less lateral loading and frequency of vehicle contact than the perimeter boards, because they are inset, that is, in the interior, and the primary vehicle loading is compressive loading from above, not lateral loading. In addition, the filler boards are captive on all edges, providing additional security.

As determined by the inventors, the filler boards can stay in place during traversing events even with no anchors installed. In the present system, all or some of the filler boards can be tied together with interlocking connectors, creating a unitary structure.

FIG. 1 illustrates an embodiment of a modular roundabout or traffic calming system 10 for vehicular traffic employing interlocking connectors 30. The system includes perimeter boards 22 and filler boards 26 that can be arranged in a generally circular roundabout pattern having a perimeter portion and an interior portion, to form a generally circular roundabout of any diameter. Any desired board pattern can be used. In some embodiments, the boards can be arranged in concentric rings, with the boards having a trapezoidal shape in plan view so that they can be further arranged in wedges extending radially between the perimeter and a central region. In some embodiments, the wedges can be truncated such that they do not terminate at a central point. In some embodiments, boards in the central region can be arranged in a different pattern, or the central region can be left free of boards. In some embodiments, modular boards can be formed into other configurations, in addition to a generally circular roundabout. For example, boards can be formed into a splitter island, which can have a variety of configurations, such as triangular, trapezoidal, rectangular, or square. The configuration can depend on the traffic conditions and roadway type, size, and configuration. For purposes of ease of description, the term "roundabout" is used, but it will be appreciated that such other configurations can be encompassed by that term as used herein. The systems and methods described herein can be applied to other traffic calming systems, including for example, splitter islands, in addition to generally circular central islands.

The perimeter boards 22 can be secured to the ground surface with anchors 24. All or a portion of the filler boards 26 can be affixed to one or more adjacent boards with interlocking connectors. One or more interlocking connectors can be located along each long edge of adjacent boards and/or along each short edge of adjacent boards. Interlocking connectors can be located between filler blocks and adjacent perimeter blocks, along adjacent edges between the perimeter boards, and between boards in adjacent wedges. In some embodiments, a number of the filler boards 26' can also be secured to the ground surface with anchors.

Figure 2:
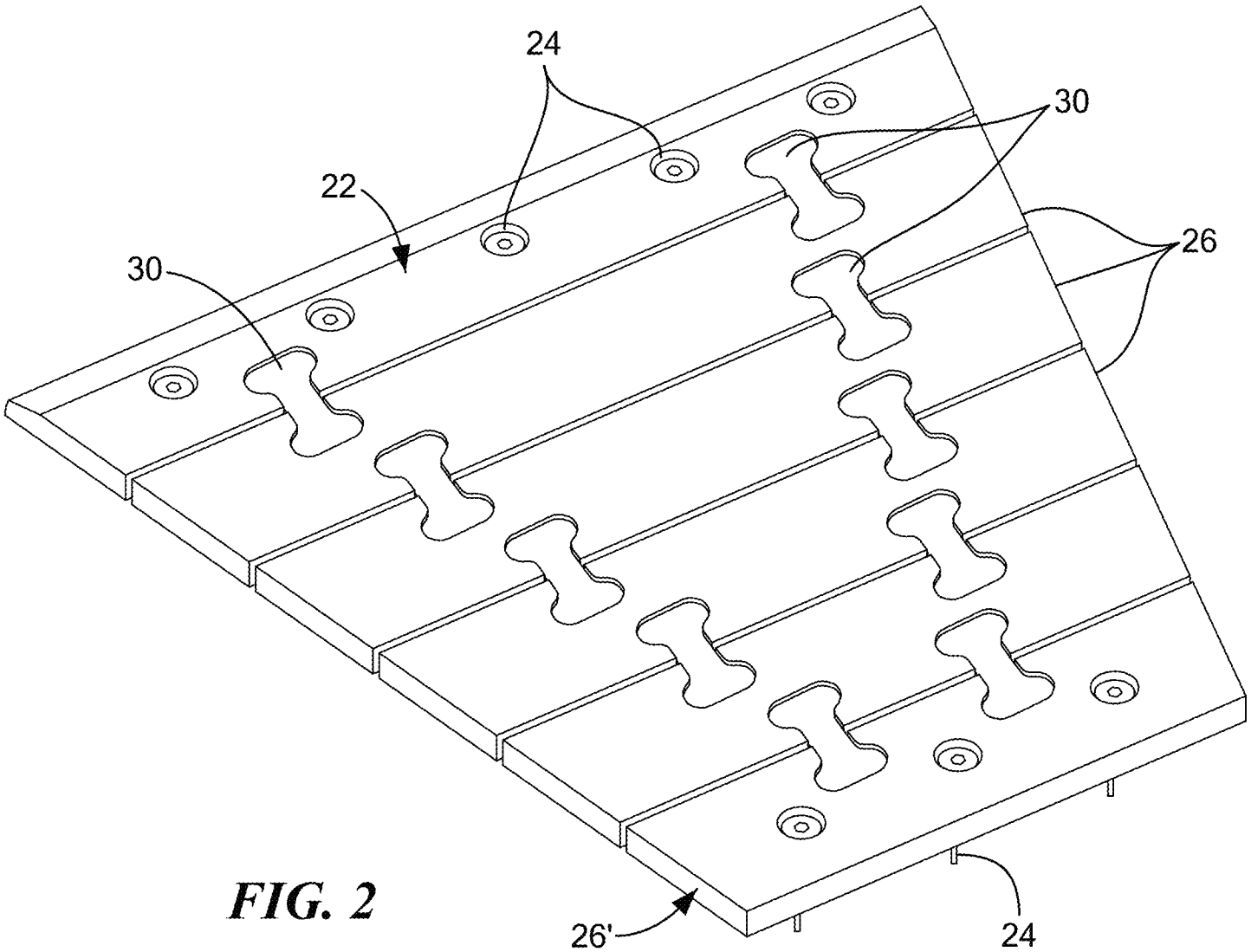
FIG. 2 is a schematic illustration of a wedge of interconnected boards of a modular roundabout system.
Figure 3:
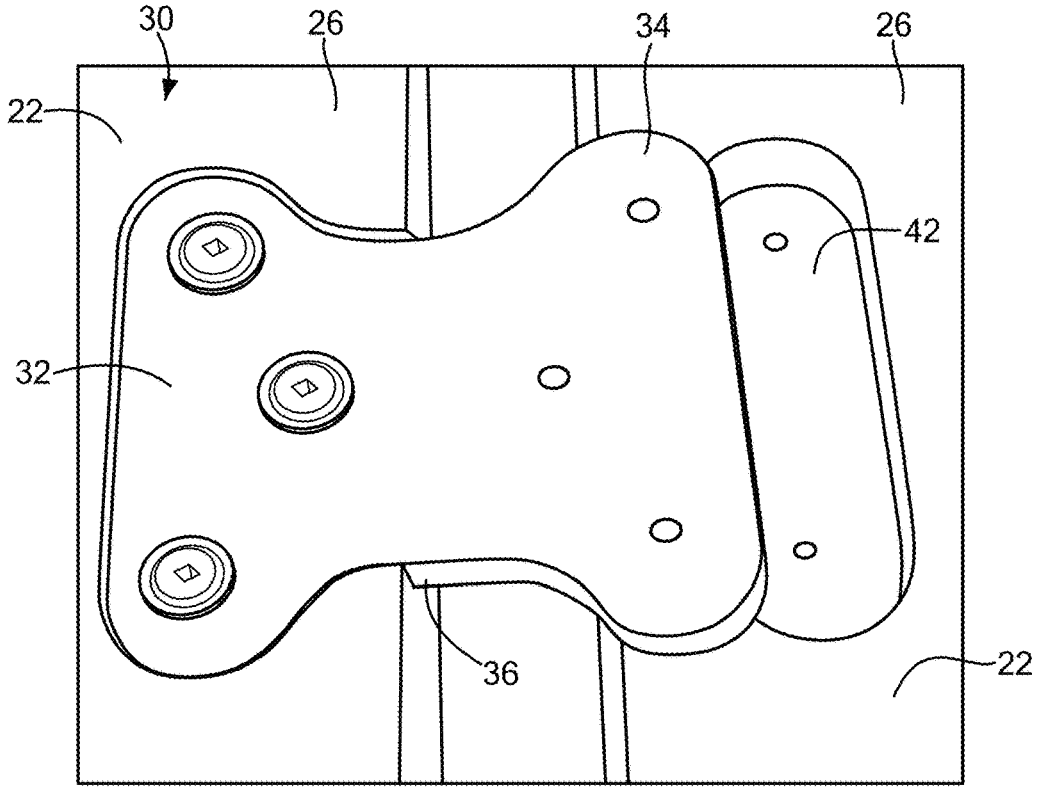
FIG. 3 is a plan view of an embodiment of an interlocking connector.
Figure 4:
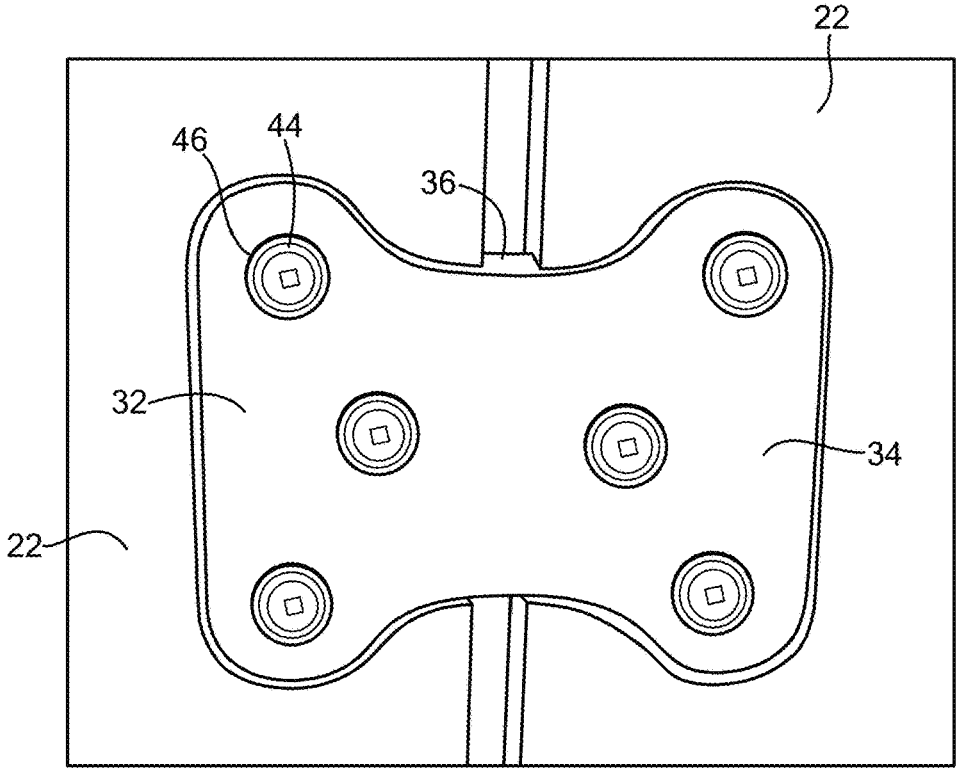
FIG. 4 is a further plan view of the interlocking connector of FIG. 3.

Referring to FIGS. 2-4, each interlocking connector 30 can be fastened to a surface of two adjacent boards. In the embodiment illustrated, the interlocking connector has a first portion 32 connectable to an upper surface of a first board and a second portion 34 connectable to an upper surface of a second board. A linking portion 36 connects the first portion and the second portion of the interlocking connector. In some embodiments, a recess 42, which can have a complementary shape with each of the first and second portions, can be machined or molded into the upper surfaces to form a seat for each portion of the interlocking connector so that the connector is flush or below the surrounding upper surface. In some embodiments, the interlocking connector can be mounted on the surface with no recess. The interlocking connector is illustrated as fastened to an upper surface of the boards; however, the interlocking connector can be fastened to a lower surface or a side edge as well.

The interlocking connector can have any suitable configuration. In some embodiments, the interlocking connector can have a dog-bone configuration, as shown in FIGS. 2-4. In some embodiments, the interlocking connector can have other configurations, such as, without limitation, a rectangular shape, a square shape, a dovetail shape, a T-shape, or an I-shape.

Each connector can be fastened to the board from the top, to simplify installation and repair or removability. Any suitable fasteners can be used to attach the interlocking connectors to the boards. In some embodiments, wood screws 44 and sub-flush washers 46 can be used to hold the connector in place. In some embodiments, holes for the screws can be predrilled in the boards, and in some embodiments, no pre-drilling is required to install the screws. In some embodiments, the screws can be taken out and replaced multiple times with no perceived loss in thread strength. For example, the interlocking connectors can be readily removed to replace a damaged board or section of boards or to remove the roundabout.

The interlocking connector can be made from any suitable material. In some embodiments, the interlocking connector can be made from a urethane rubber. In some embodiments, the interlocking connector can have a hardness ranging from about Shore Hardness 30A to about Shore Hardness 50D. In some embodiments, the interlocking connector can have a Shore 90A hardness. In some embodiments, the thickness of the connector can range from about 1/16 inch to about 2.5 inches. In some embodiments, the connector can be about 0.5" thick.

Figure 5:
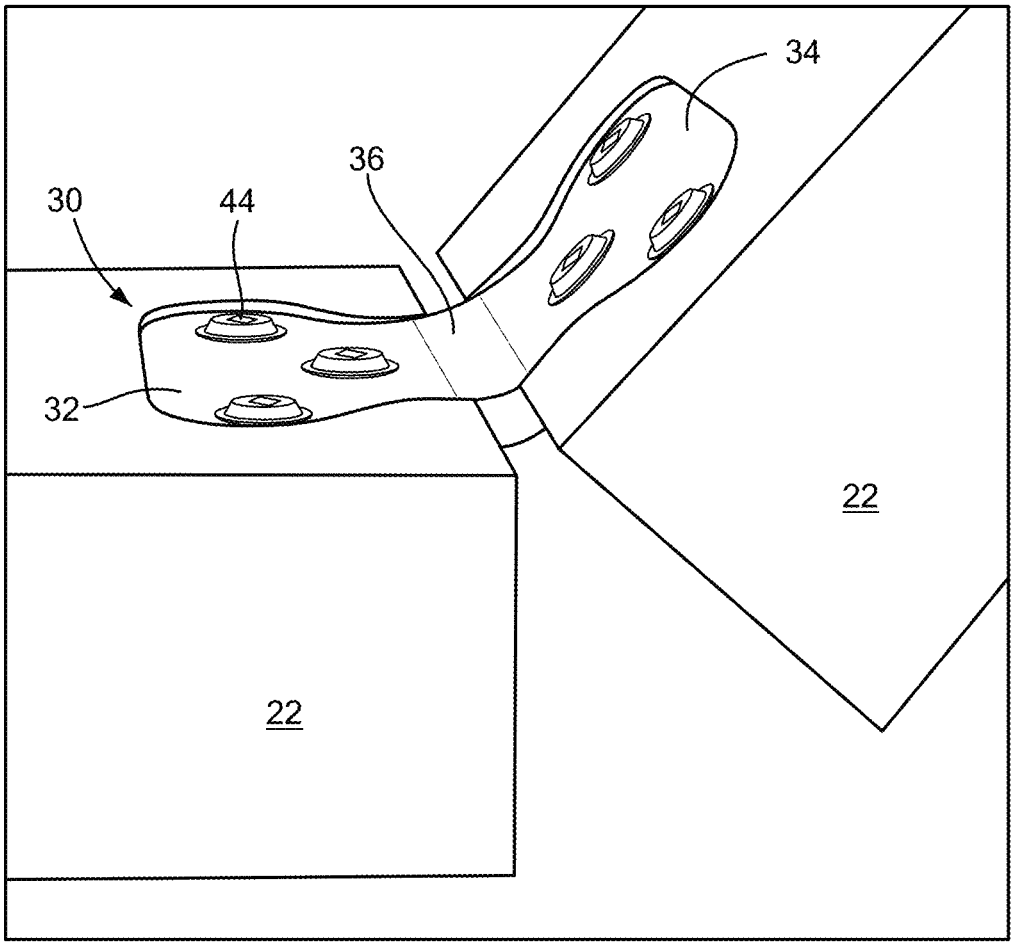
FIG. 5 is a side view of an embodiment of a flexible interlocking connector.
Figure 6:
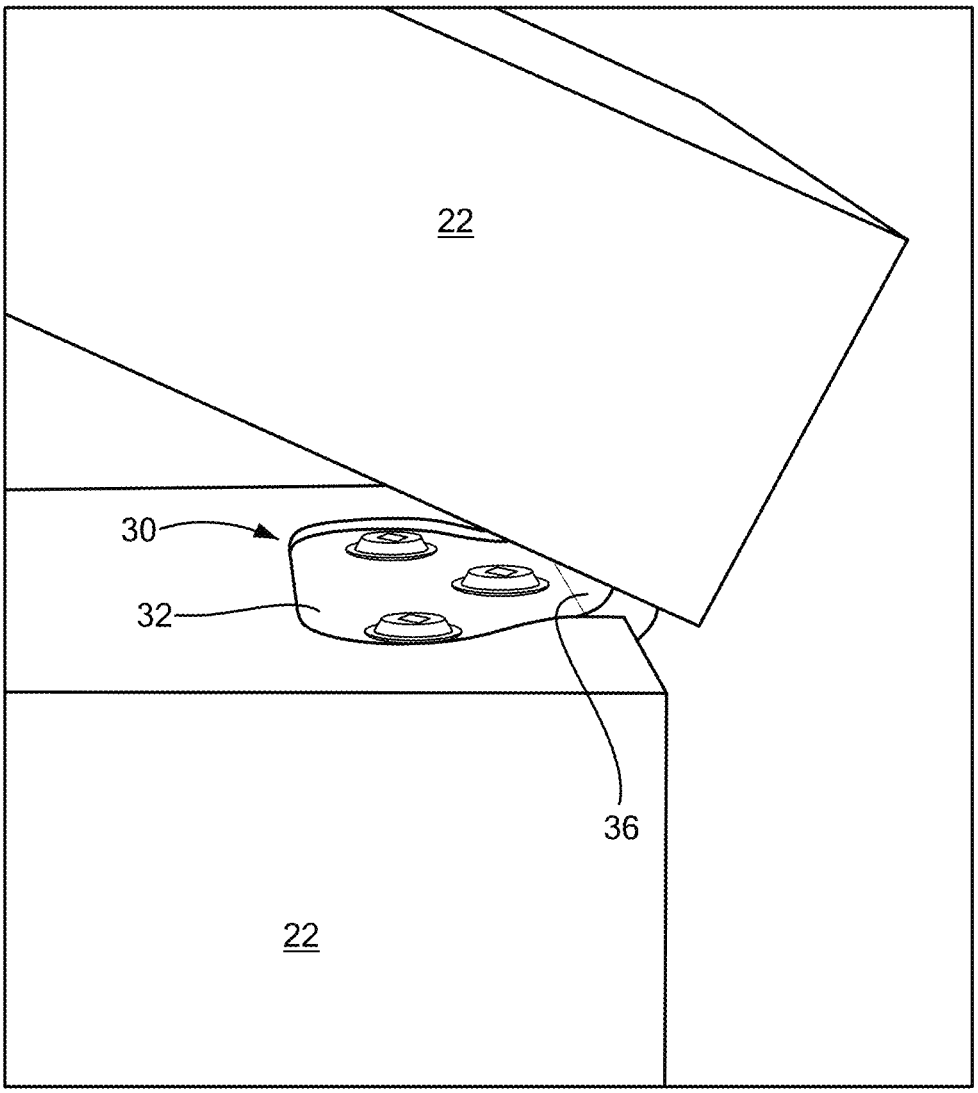
FIG. 6 is a further side view of the interlocking connector of FIG. 5.

In some embodiments, the interlocking connector can be rigid. In some embodiments, the interlocking connector can be strategically compliant. For example, the connector can include fiber reinforcing, such as a fiber-reinforced urethane, to provide optimal strength and stiffness where it is needed and afford flexibility for assembly and thermal expansion. For example, fiber reinforcing can be added to increase tensile strength. In some embodiments, the linking portion of the interlocking connector can be a flexible hinge joint between the first and second portions. The flexible hinge joint allows adjacent boards to be folded as indicated in FIGS. 5 and 6, which can be useful for shipping or transporting the roundabout system, described further below. The flexible hinge can be formed with a bias or springiness to return to a flat configuration after folding, for example, by forming the connector of an appropriate elastomeric material, such as a urethane, and/or incorporating appropriate fiber reinforcing.

Figure 7:
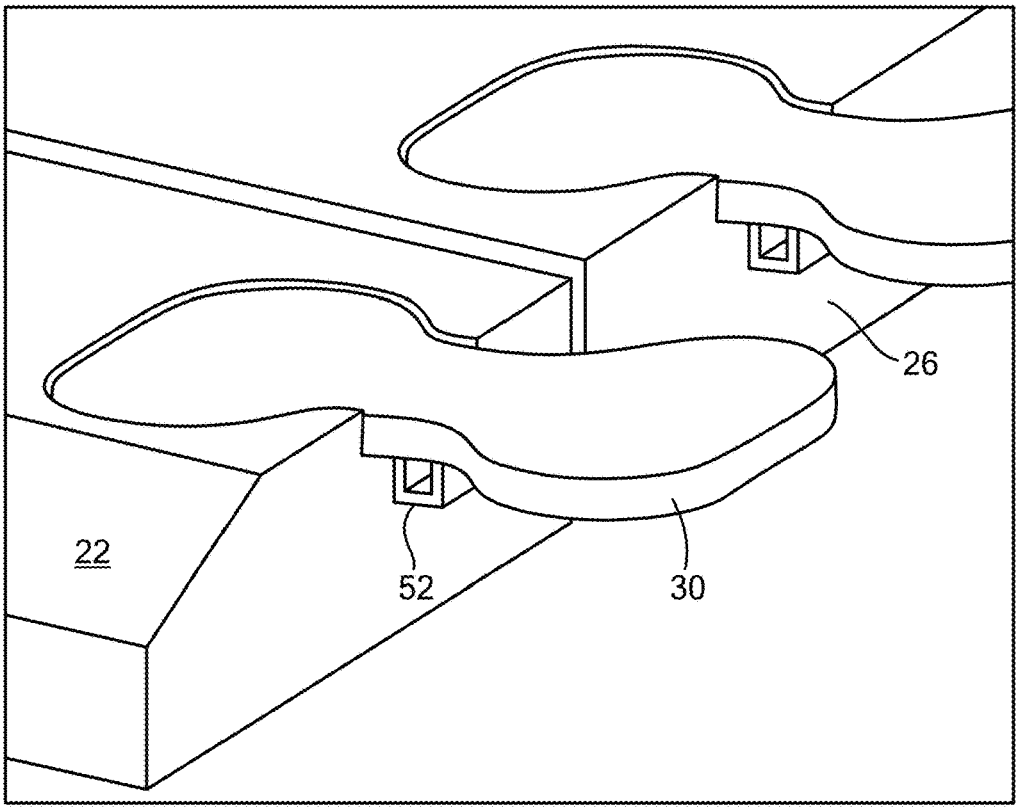
FIG. 7 is a schematic illustration of an embodiment of an interlocking connector, in phantom, for a perimeter board including a spacer.
Figure 8:
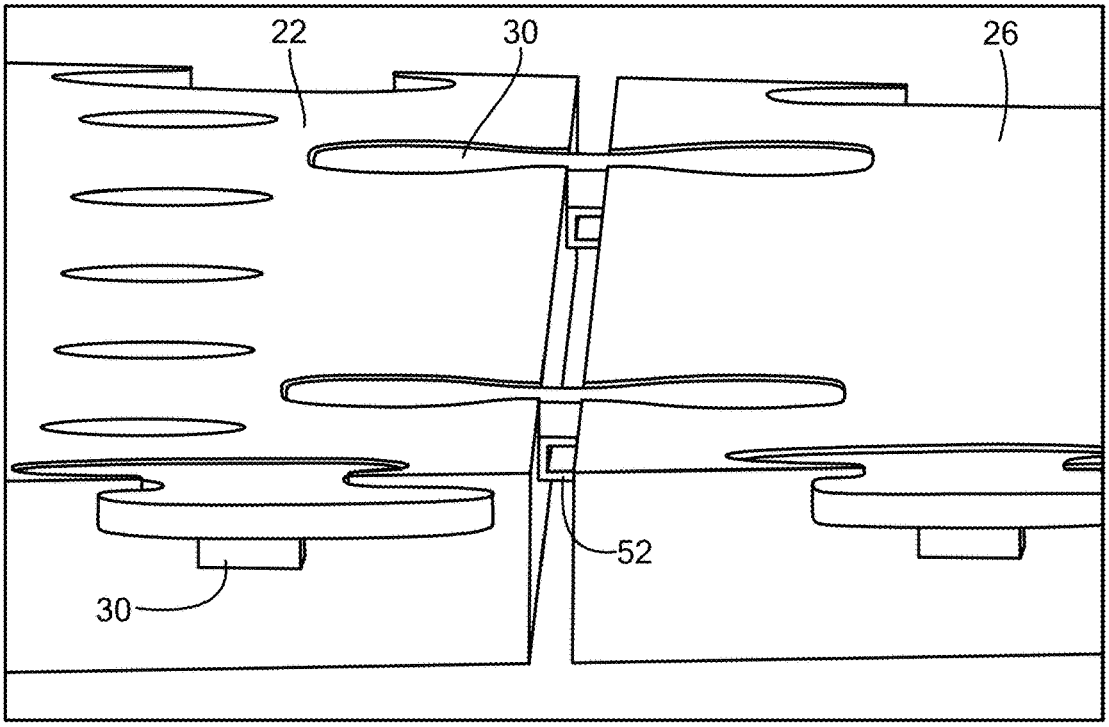
FIG. 8 is a schematic illustration of embodiments of interlocking connectors including a spacer.

In some embodiments, the linking portion can include a spacer 52 that can hang downwardly into a gap between side edges of the adjacent boards, to assist in maintaining a suitable spacing between the boards in the roundabout. See FIG. 7. The spacer can also assist in resisting buckling of the interlocking connector from lateral forces. The spacer can be hollow or solid or can have any other conformal geometry. The spacer can be manufactured integrally with the interlocking connector as a single piece, such as by molding, or can be manufactured as a separate piece in a secondary process. In some embodiments, the linking portion can include both a flexible hinge joint and a spacer.

Figure 9:
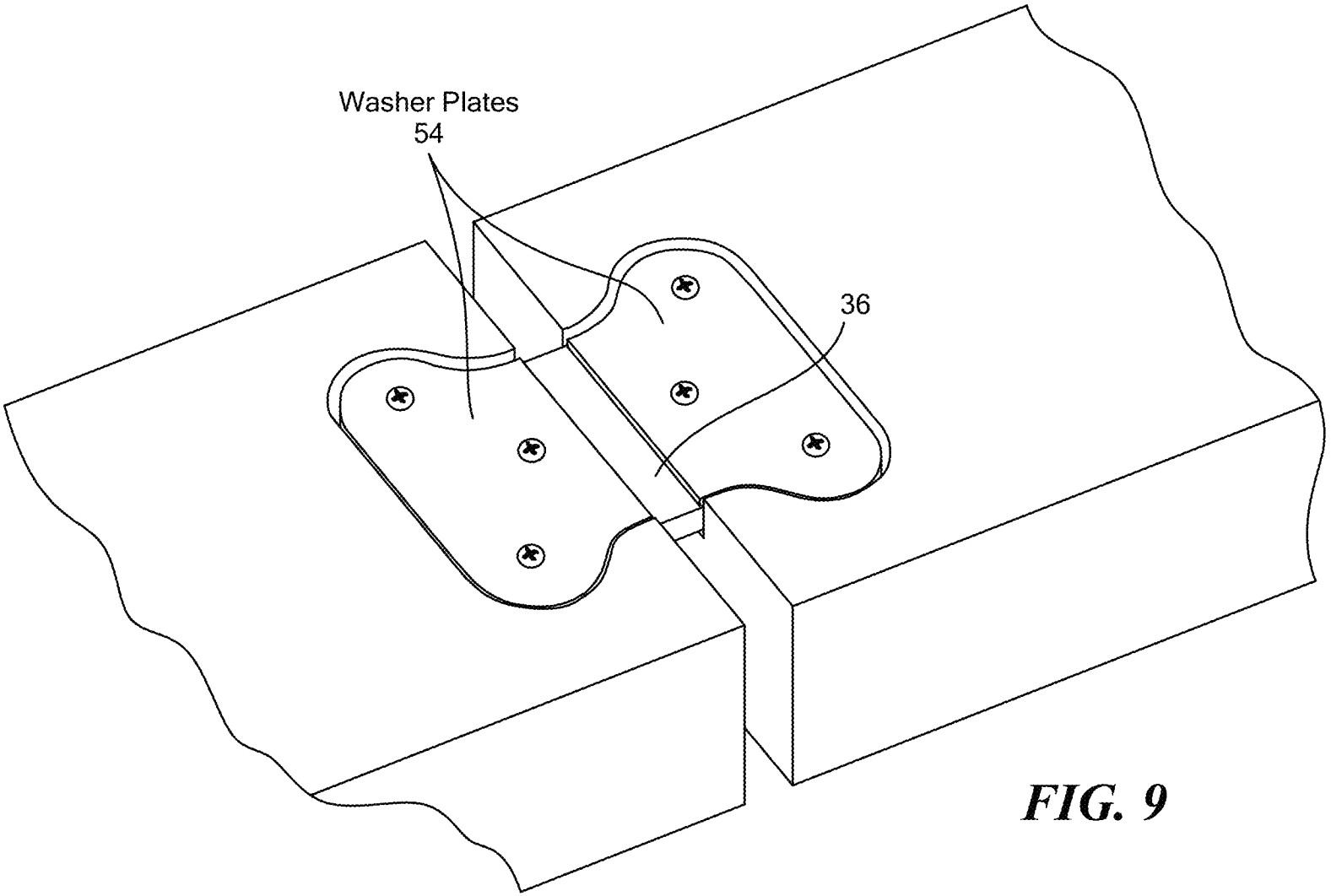
FIG. 9 is a schematic partial view of an interlocking connector including washer plates.

In some embodiments, the interlocking connector can include a washer plate 54 above and adjacent to each portion of the interlocking connector. See FIG. 9. The washer plate can help to distribute forces on the interlocking connector. For example, the washer plate can help resist buckling of the interlocking connector from lateral forces. The washer plate can be made of any suitable material, such as a metal or a non-metal.

The present roundabout system can leverage the strength of connecting all the boards together into a single unit, while allowing for thermal expansion, water-shedding, better absorption of impacts, and installation tolerance. The system can minimize the number of anchors required for the entire system, which can be the most time-consuming aspect of installation. In some embodiments, anchors can be used for only a few strategic internal filler boards. This can reduce the total number of anchors while allowing an increase in the number of anchors where they are primarily needed, in perimeter boards. Thus, the interlocking connector approach can reduce the number of anchors, reduce installation time and cost, and increase system robustness by increasing perimeter anchors and connecting all boards to each other to spread and absorb impacts.

In addition to the reduction of anchors, significant sub-assembly can be completed prior to site delivery. A section of a roundabout pattern can be formed as a sub-assembly with interlocking connectors installed to tie each board of the section together at the site of manufacture. A sub-assembly can have any desired configuration, such as a wedge section of a circular roundabout, a rectangular or polygonal central section of a roundabout, or any section of another pattern, such as a splitter island. In some embodiments, a sub-assembly can include a perimeter board. In some embodiments, a sub-assembly can include a board, such as a perimeter board or filler board, that is also to be attached to the ground with one or more ground anchors. In some embodiments, once the boards have been connected together with interlocking connectors, the sub-assembly can be rolled up for more efficient transportation to the site of installation.

Figure 10:
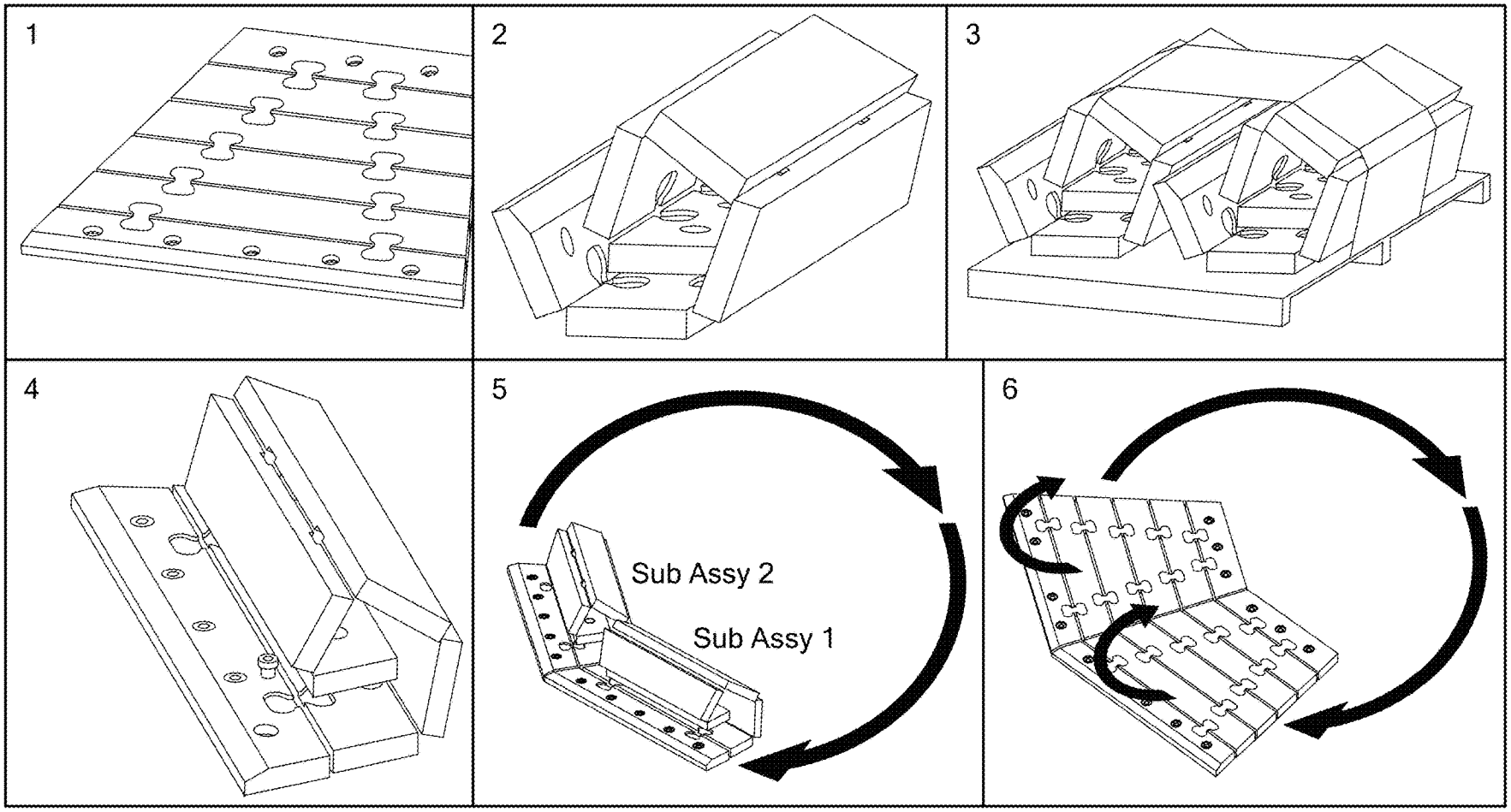
FIG. 10 is a schematic illustration in six panels of an embodiment of a method of installation of a modular roundabout system.

FIG. 10 illustrates an embodiment of a process for a wedge section of a roundabout pattern, which can include, for example, twelve similar wedge sections. In panel 1, a sub-assembly of a wedge section is laid out and interlocking connectors are installed to tie all the boards together at the site of manufacture. In panel 2, because the interlocking connector is engineered to be flexible when folding, the sub-assembly is rolled up. Each rolled-up sub-assembly is secured in a rolled position individually or as a group with one or more other rolled-up sub-assemblies. In panel 3, two rolled sub-assemblies are secured on a pallet for shipping. The palletized sub-assemblies can be marked for efficient shipping and field placement. In panel 4, the sub-assemblies are placed in marked areas in the field and a perimeter board from each of the sub-assemblies is anchored to the ground surface using suitable ground anchors. In panel 5, once all sub-assemblies are fixed in place at one end and properly spaced in relation to each other, they are unrolled. In panel 6, the other side of the sub-assemblies is anchored to the ground surface. Each board can then be connected via an interlocking connector on the shorter end to an adjacent board, as shown in FIG. 1. With this installation method, connection requires minimal effort to assemble and fold up and provides the ability to "self-assemble" or unroll in the field once positioned into the appropriate place.

In some embodiments, individual boards can be partially assembly at the site of manufacture, minimizing the additional assembly needed at the roundabout site. For example, one portion of an interlocking connector can be installed on a board at the manufacturer's site and the other portion can be attached to an adjacent board in the field. This installation process can be useful if heavy equipment is not available at the roundabout site to move the larger, heavier rolled-up sub-assemblies described above.

In some embodiments, installation time can be reduced by 50-75% using this system and method, particularly if heavy equipment is available to move the rolled-up sub-assemblies. In some embodiments, the cost of fabricating and installing a roundabout system can be reduced by 25-40%.

In some embodiments, the modular roundabout system can be provided as a kit. The boards can be prefabricated and shipped to a work site as a kit of parts, including all the boards formed in the appropriate shapes, the ground anchors and the interlocking connectors. The kit can include rolled-up sub-assemblies as described above.

Figure 11:
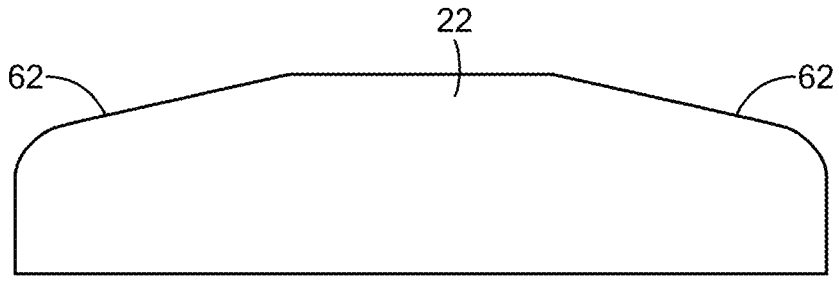
FIG. 11 is a schematic cross-sectional illustration of an embodiment of a board with an edge detail.
Figure 12:
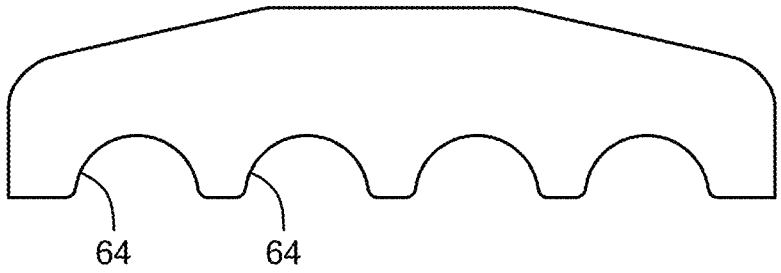
FIG. 12 is a schematic cross-sectional illustration of an embodiment of a board with additional features to reduce material.

In other aspects, a modular roundabout system can include perimeter boards 22 that can have an edge detail, such as a bevel or slope 62, machined or molded into the profile. In some embodiments, the edge detail can be provided on both of the longer sides of each board. See FIG. 11. In some embodiments, other material reductions can be incorporated into the cross-section during the tooling design to further reduce the amount of material and associated cost. For example, FIG. 12 illustrates weight-lightening features 64 such as cut out regions along the bottom surface of a board to reduce the material. The features to reduce the amount of material can be incorporated into the tooling design. Molding the edge detail and other features can reduce both the amount of material and the time that would otherwise be spent to machine it. Based on the geometry, including such an edge detail on one or both edges and other weight-lightening features can reduce material usage by up to 25% per board.

In some embodiments, the edge detail and other cut out features can also be applied to the interior boards as well as to the perimeter boards. Including such features on many or all of the boards can further increase the material and manufacturing savings. Such a dual edge detail on the interior boards can also provide an additional calming affect for vehicles traversing the islands, due to the variations in surface topography.

Figure 13:
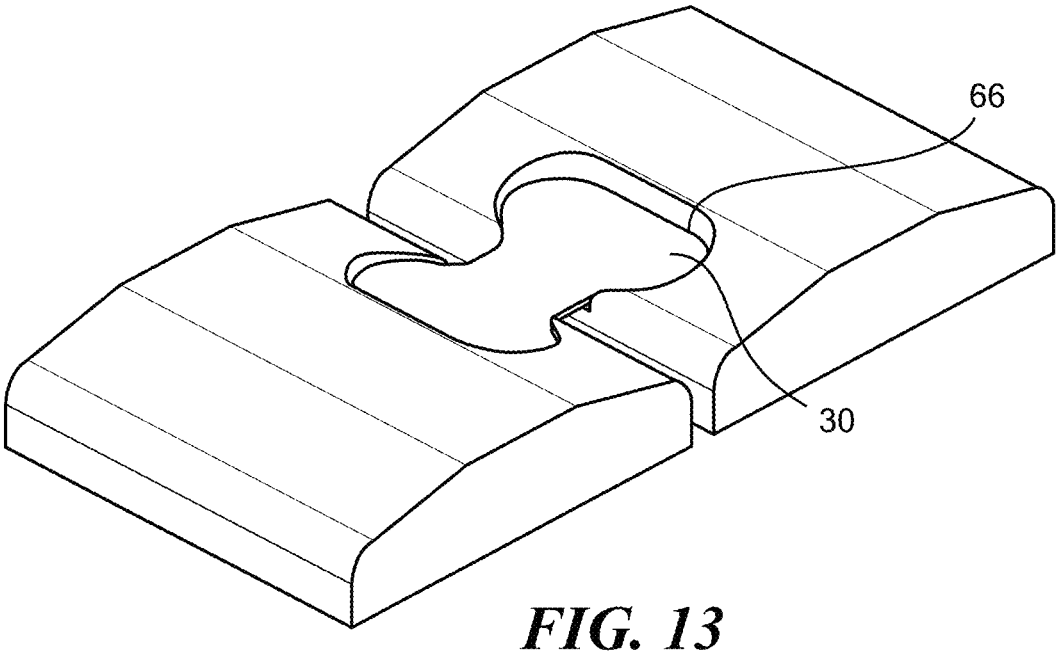
FIG. 13 is a schematic isometric illustration of the board of FIG. 11 with interlocking connector.
Figure 14:
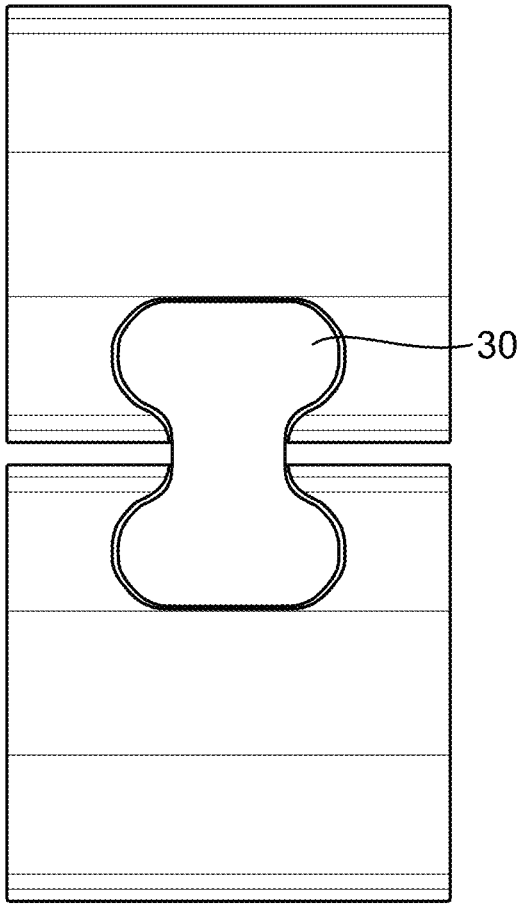
FIG. 14 is a schematic top plan view of the board and interlocking connector of FIG. 13.
Figure 15:
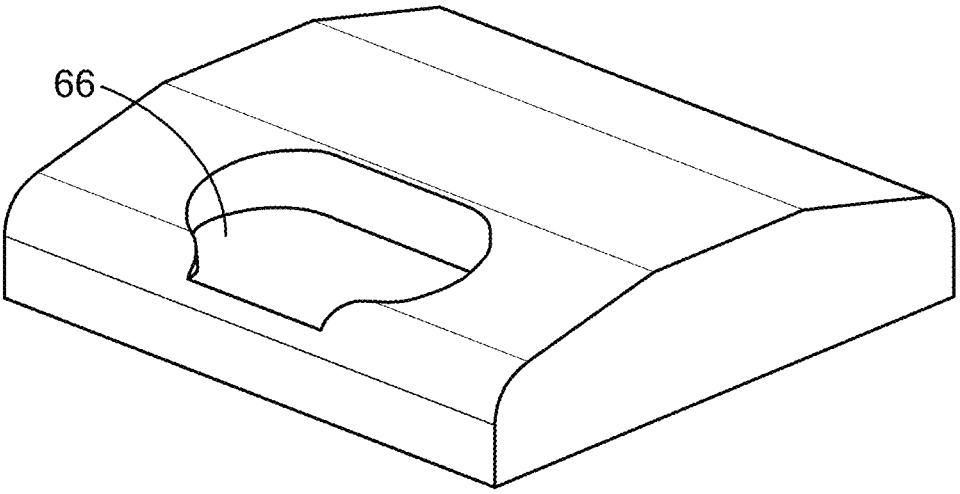
FIG. 15 is a schematic isometric view of the board of FIG. 11 with a cavity for the interlocking connector.

Boards with a dual edge detail can be connected with interlocking connectors. Referring to FIGS. 13-15, cavities or pockets 66 for the portions of the interlocking connector can be machined or molded into the boards. In some embodiments, the cavity can have a flat bottom and a variable depth relative to the upper surface. See FIG. 15. In some embodiments, the cavity can have a constant depth parallel to the flat surface. The interlocking connector can be made flat with a constant thickness (FIG. 13) or can be made with a variable thickness to more closely conform to the shape of the cavity.

In a still further aspect, additional hold-down plug configurations for ground anchors can be provided. In known ground anchors, a hollow, internally threaded insert is set into grout in a hole in the ground. A hold-down plug is placed in a through hole in the board, and a fastener bolt is placed through the plug and threaded into the insert in the ground. The plug serves as a washer and allows the boards to be tightly clamped to the ground to permit a loose tolerance in drilling the ground hole and positioning the hollow insert and fastener bolts. The grout is allowed to cure for a suitable time before the bolt is finally tightened. Prior art hold-down plugs have a truncated conical or pyramidal configuration, as can be seen in WO 2017/044734.

Figure 16A:
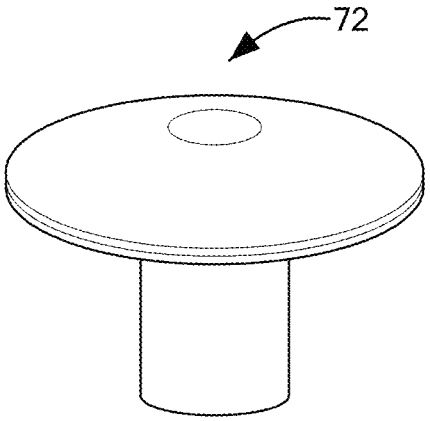
FIG. 16A is a schematic illustration of an embodiment of a hold-down plug for a ground anchor.
Figure 16B:
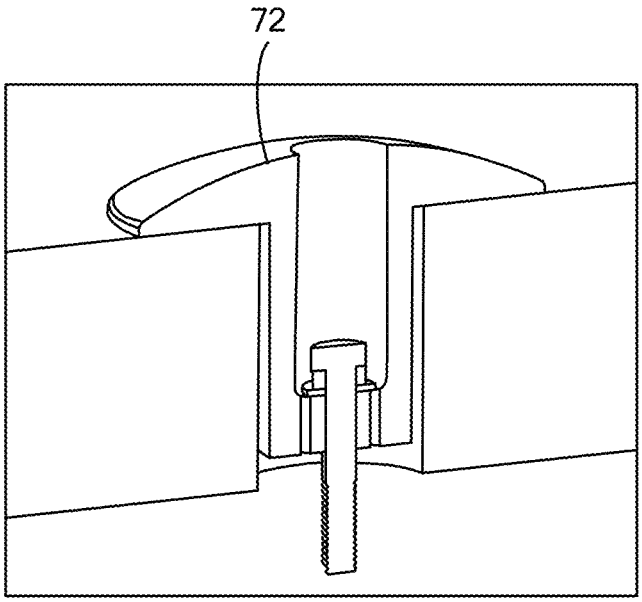
FIG. 16B is a schematic illustration of the hold-down plug of FIG. 16A installed with a ground anchor.

FIGS. 16A and 16B illustrate a generally mushroom-shaped plug 72 formed from a thermoplastic urethane or polyurethane (TPU) material. The large top cover of this plug can improve visibility. The larger surface area can also expose the cap to lateral and compressive forces from vehicle tires as well as lateral loading from low hanging structure, so it is not as useful in applications where these forces could be large.

Figure 17A:
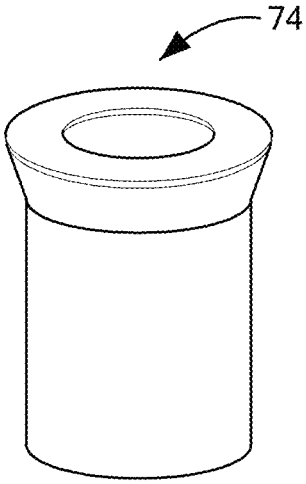
FIG. 17A is a schematic illustration of a further embodiment of a hold-down plug for a ground anchor.
Figure 17B:
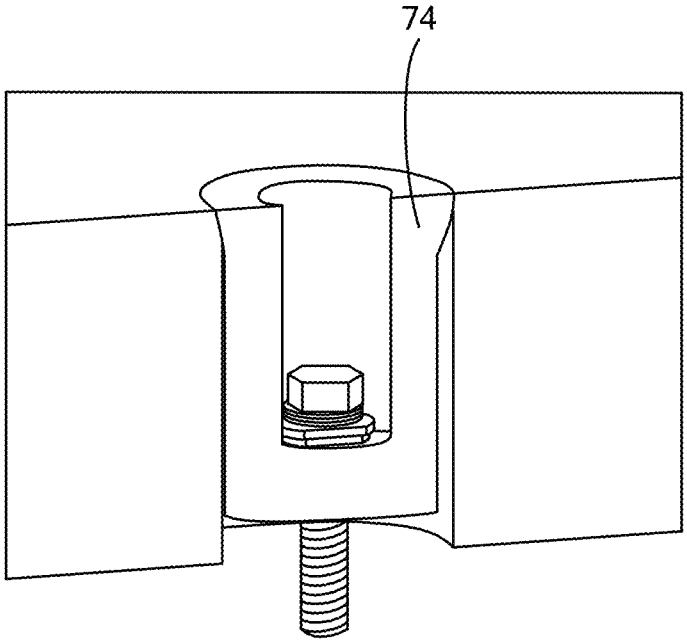
FIG. 17B is a schematic illustration of the hold-down plug of FIG. 17A installed with a ground anchor.
Figure 18A:
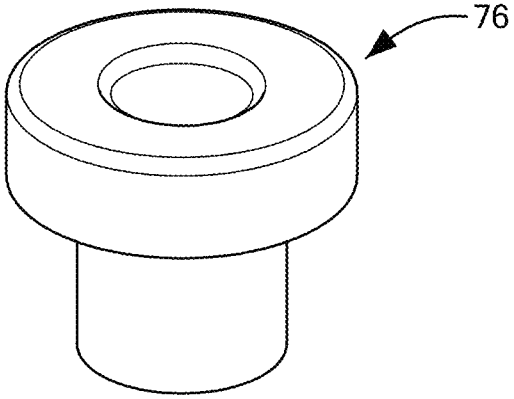
FIG. 18A is a schematic illustration of a further embodiment of a hold-down plug for a ground anchor.
Figure 18B:
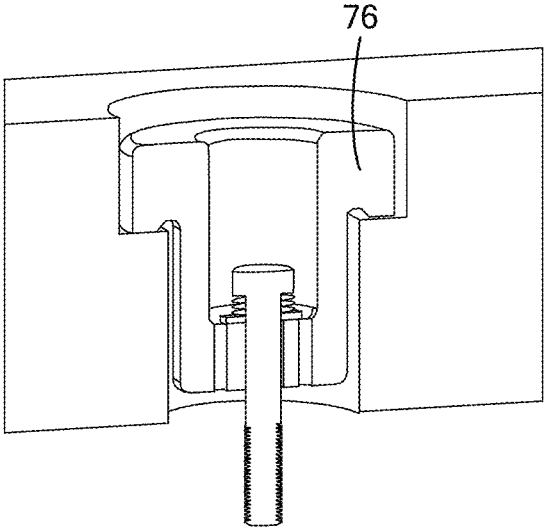
FIG. 18B is a schematic illustration of the hold-down plug of FIG. 18A installed with a ground anchor.
Figure 19A:
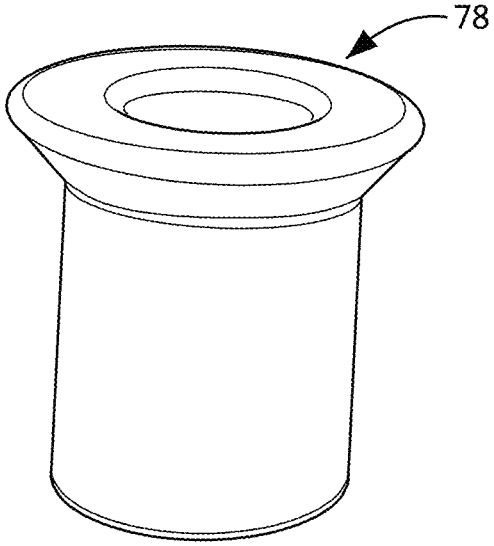
FIG. 19A is a schematic illustration of a further embodiment of a hold-down plug for a ground anchor.
Figure 19B:
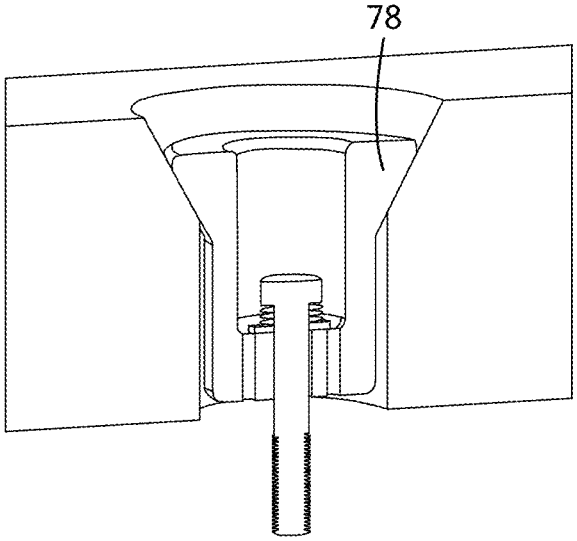
FIG. 19B is a schematic illustration of the hold-down plug of FIG. 19A installed with a ground anchor.

FIGS. 17A and 17B illustrate a wedge-shaped plug 74 formed from a metal such as aluminum. This plug can be recessed below the upper surface of the board and can be installed in a straight through-hole. The aluminum plug can require less machining and can be relatively easy to install in the field.

FIGS. 18A, 18B, 19A, and 19B illustrate plugs 76, 78 that can be recessed below the top surface of the board. These plugs can suitably be formed from a material such as a urethane rubber. The plug in FIGS. 18A and 18B can employ a counterbore, and the plug in FIGS. 19A and 19B can employ a countersink. The recessed plugs do not contact the vehicle, which can be advantageous. The urethane plugs can be formed by molding.

In some embodiments, a roundabout central island can have a diameter ranging from about 5 feet to about 120 feet, although larger or smaller diameters can be provided if desired. In some embodiments, a splitter island can range from about several feet to hundreds of feet in length, although the length and configuration can depend on the application. In some embodiments, the thickness of the boards can range from about 2 inches to about 8 inches, although greater or lesser thicknesses can be provided if desired. In some embodiments, the width of trapezoidal boards in a radial direction can range from about 6 inches to about 36 inches, although greater or lesser widths can be provided. In some embodiments, the roundabout can withstand occasional truck loads of at least about 22,000 lb/axle. In some embodiments, the roundabout can withstand occasional truck loads of greater than 22,000 lb/axle.

In some embodiments, a roundabout can have a circular shape; in some embodiments, the shape can be generally circular with straight segments along the edges. In some embodiments, a roundabout can have a shape other than circular. For example, a roundabout can have an elliptical shape or a dog-bone shape. In some embodiments, a roundabout can have an irregular or asymmetrical shape. For example, a roundabout can be generally circular with a "bump out" on one side. A bump out can be used to modify or redirect traffic flow, depending on the configuration of the location where the roundabout is placed.

The modularity of embodiments of a roundabout or traffic calming installation as described herein can be advantageous in simplifying post-installation shape changes. For example, a roundabout originally installed with a circular shape can be subsequently modified to include a bump out on one side by the addition of new boards. A portion of the original boards can be removed if needed to accommodate the addition of new boards. Boards can be moved from one spot to another after installation if desired. For example, boards can be removed from a splitter island and added to an originally circular roundabout to create a shape change with minimal cost. Making such changes to traditional concrete or asphalt roundabouts after installation is much more difficult and costly.

The boards can be made of any suitable material. In some embodiments, a polymer material can be used. The material can be elastomeric, thermoplastic, or a combination of thereof to achieve desired characteristics.

In some embodiments, polyolefins such as polypropylene (PP), polyethylene (PE), or high density polyethylene (HDPE) can be used as a base polymer. In some embodiments, the modular blocks can be made from recycled materials. In some embodiments, engineering polymers such as polyethylene terephthalate (PET) or polyamide (Nylon) can be used as a base polymer. For example, PET can be recycled from soda bottles and PP can be recycled from various consumer goods, such as food packaging and outdoor equipment. In some embodiments, crumb rubber (CR), obtained from recycled tires, can be used as an additive to a base polymer. A thermoplastic urethane or polyurethane (TPU) can be added to improve toughness, particularly to PET. In some embodiments, material compositions can include one or more of a polyolefin, poly(methyl methacrylate), acrylonitrile butadiene styrene, polybutylene terephthalate, polycarbonate and polyoxymethylene. In some embodiments, the boards can be machined from boards of recycled plastic that are used for railroad ties; such boards have an approximately 50 year life.

In some embodiments, the boards can be made of primarily high density polyethylene (HDPE) with the addition of fiber reinforcement, such as fiberglass, added for stiffness and strength. In some embodiments, the boards can be made of HDPE with no additional fiber reinforcement. Eliminating fiber reinforcement can reduce the cost of the material by approximately 10-20%. Boards without fiber reinforcement can have a reduced bending stiffness, which can promote improved conformability to non-flat road surfaces and reduce the load transferred to the ground anchors if the board does have a slight wobble. Also, with no fiberglass reinforcement, the material can be more broadly recyclable.

Boards can be manufactured in any suitable manner, such as by an extrusion process, a pultrusion process, or by molding. Board stock from suitable materials is also commercially available in a variety of sizes and lengths and can be purchased. In some embodiments, the boards can be produced by a molding process, such as compression molding, which uses high pressure to force a thermoplastic material into a tool. The process can be selected as appropriate for the application, accounting for factors such as large complex parts and extremely high viscosity resins. For a roundabout, a mold for each size and shape of board can be provided. In some embodiments, multiple boards can be cut to appropriate sizes from a single longer board.

A roundabout or traffic calming system as described herein can be placed on top of any suitable supporting surface. In some embodiments, the roundabout can be placed directly over an existing road surface, for example, of asphalt or concrete. The roundabout can be installed over existing pavement with no modification to the existing pavement.

A roundabout or traffic calming system as described herein can be installed relatively rapidly, often more quickly than traditional roundabouts, resulting in minimal traffic disruption. The roundabout can be driven over during installation, resulting in minimal traffic disruption.

A roundabout or traffic calming system as described herein can have minimal maintenance costs. The roundabout can be made from damage-resistant materials and can be resistant to snowplow damage. If a module is damaged, it can be replaced easily and quickly with no training. The roundabout can be impervious to freeze/thaw cycles, such that potholes do not form in the roundabout. The roundabout does not need to be painted. Modules can be manufactured in a variety of colors and any desired color scheme can be selected. The modules can be manufactured from recycled and/or recyclable materials.

Figure 20:
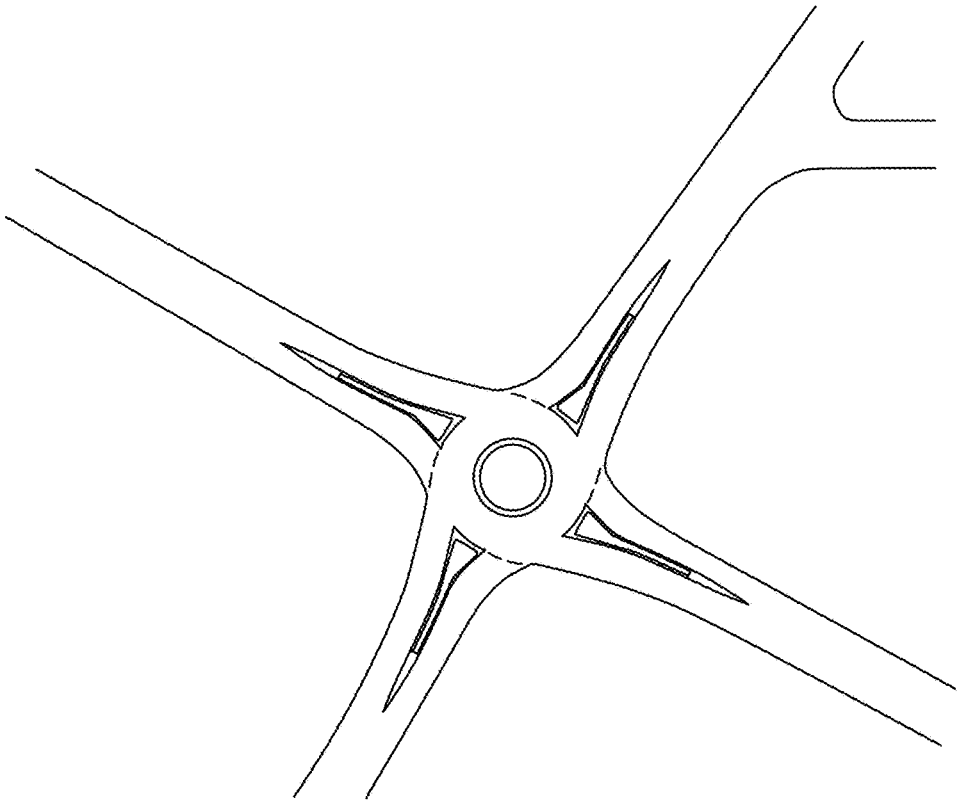
FIG. 20 is a schematic illustration of a plan of a modular roundabout or traffic calming installation.
Figure 21:
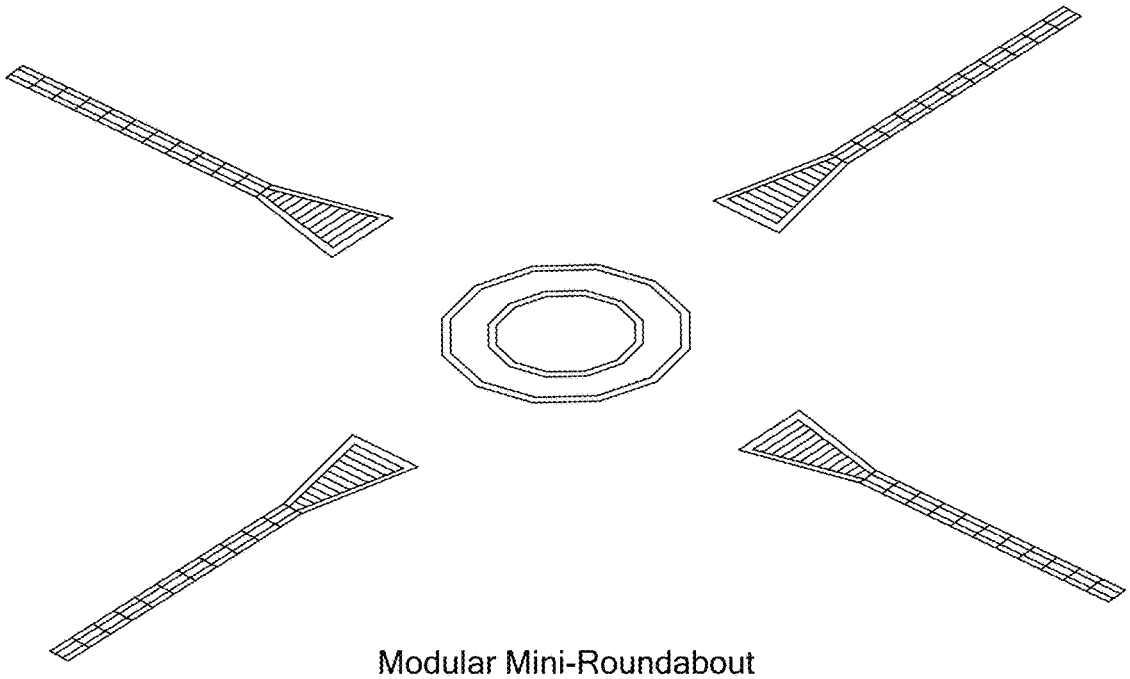
FIG. 21 is a schematic illustration of a CAD model of the modular roundabout or traffic calming installation of FIG. 20.
Figure 22:
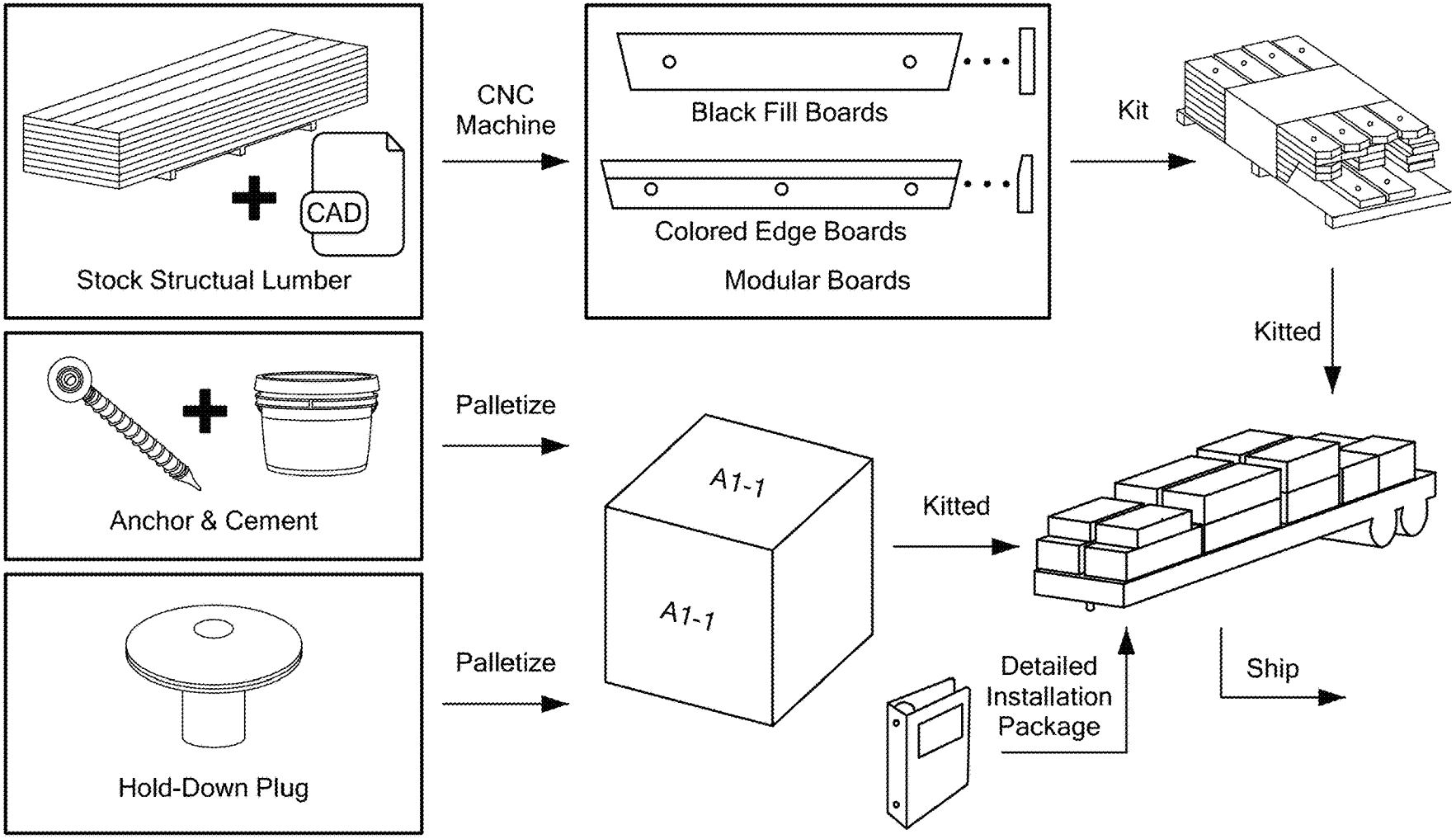
FIG. 22 is a schematic illustration of a method of making a modular roundabout or traffic calming installation.
Figure 23:
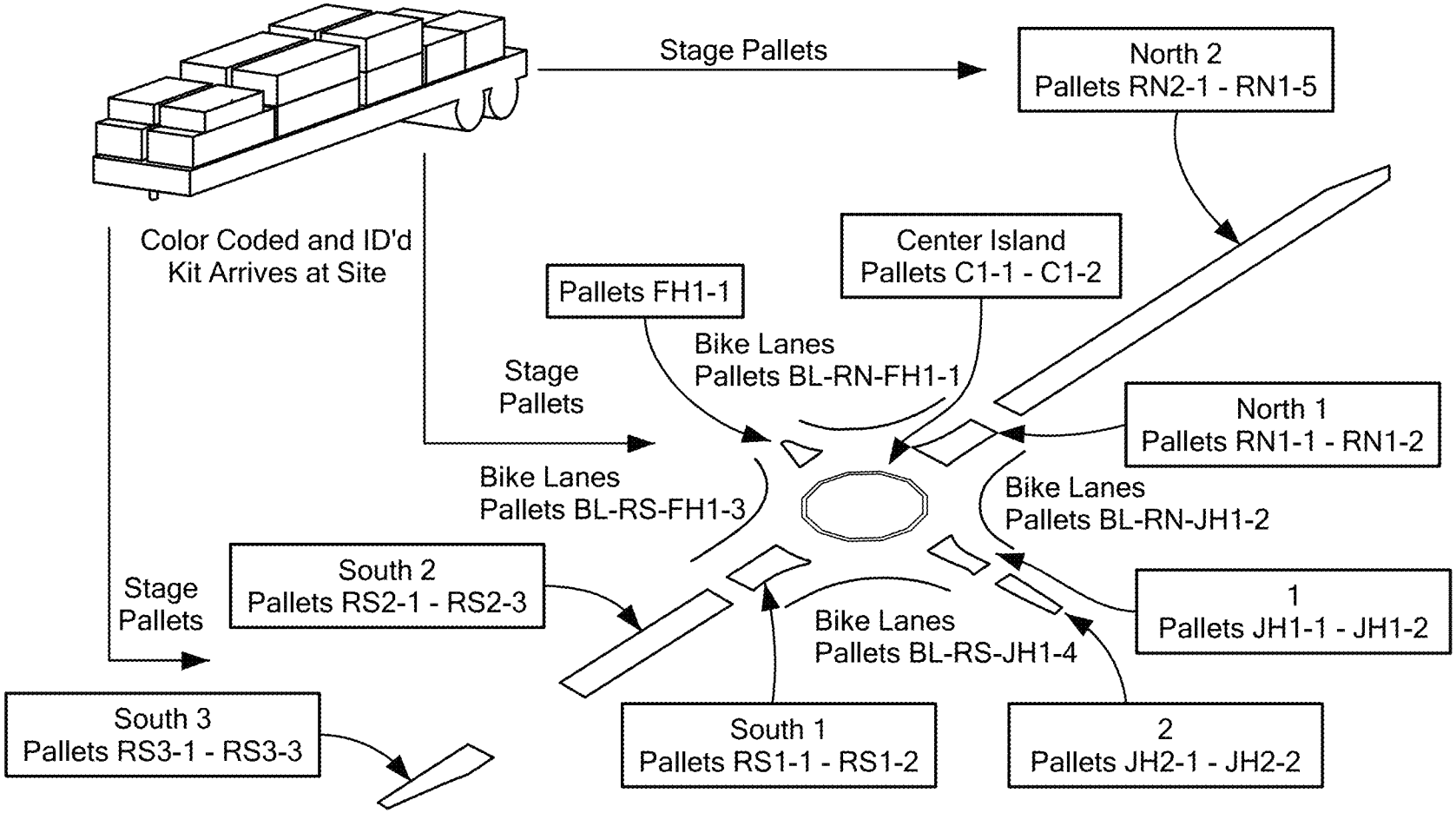
FIG. 23 is a schematic illustration of a further step in a method of making a modular roundabout or traffic calming installation.

In some embodiments, a process for designing and installing a traffic calming installation can be as follows: A design of an intersection lay-out is determined (see FIG. 20), and a modular roundabout is designed for the intersection lay-out, for example, using any suitable CAD system (see FIG. 21). Referring to FIG. 22, the number, type, and color of boards and the number and type of anchors and hold-down plugs for the roundabout are determined during the design process. The boards can be machined from stock structural lumber based on the CAD design. The boards are packaged as a kit along with the anchors, plugs, cement for the anchors, and installation instructions. In some embodiments, the boards can be identified in any suitable manner, such as by color-coded sections or pallets, to identify the various sections of the roundabout. For example, a central island can be identified by a red color, and north, south, east, and west splitter islands can be identified by blue, yellow, green, and black colors respectively. The kit is shipped to the site. At the site, the pallets are unloaded and staged at the site according to the identification (see FIG. 23).

Figure 24:
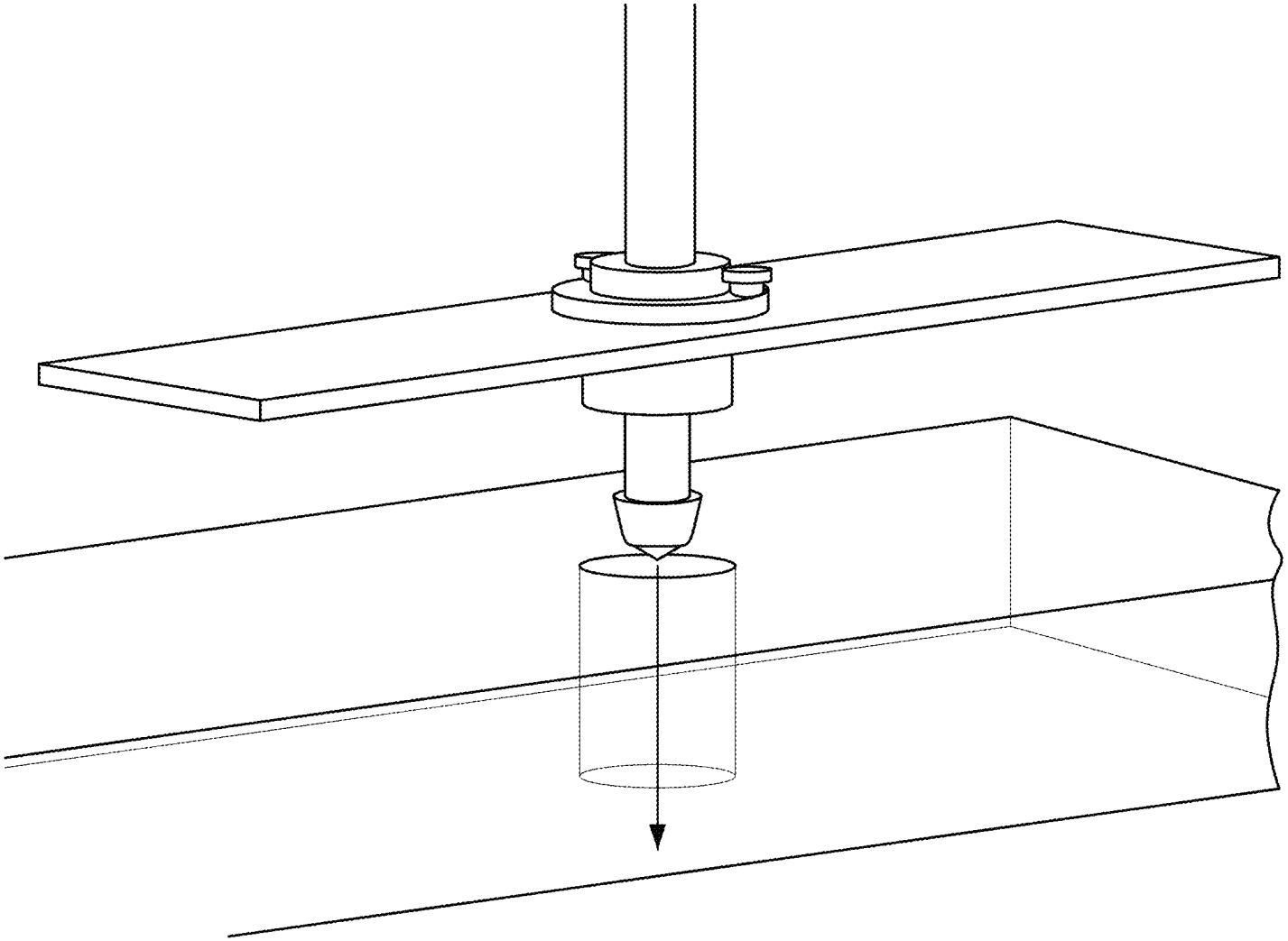
FIG. 24 is a schematic illustration of a step of drilling a hole for a ground anchor.
Figure 25:
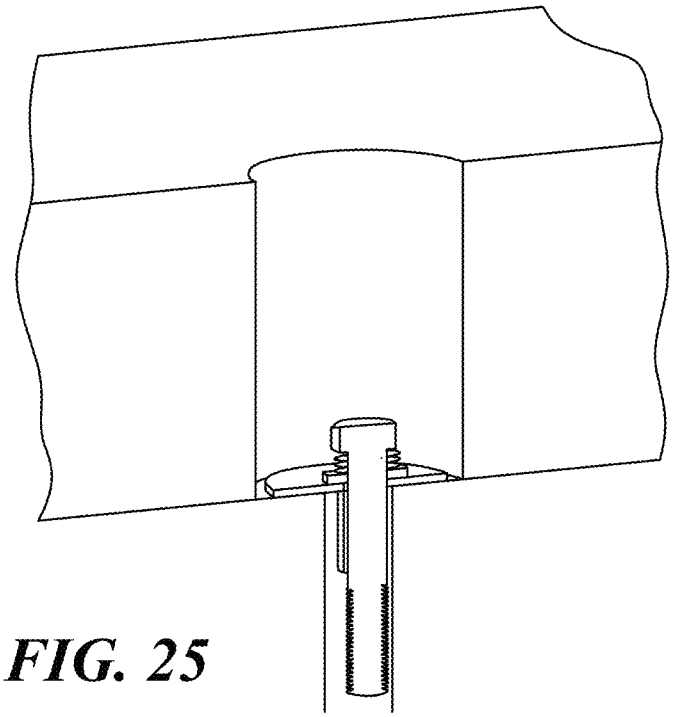
FIG. 25 is a schematic cross-sectional illustration of a step of installing a ground anchor.
Figure 26:
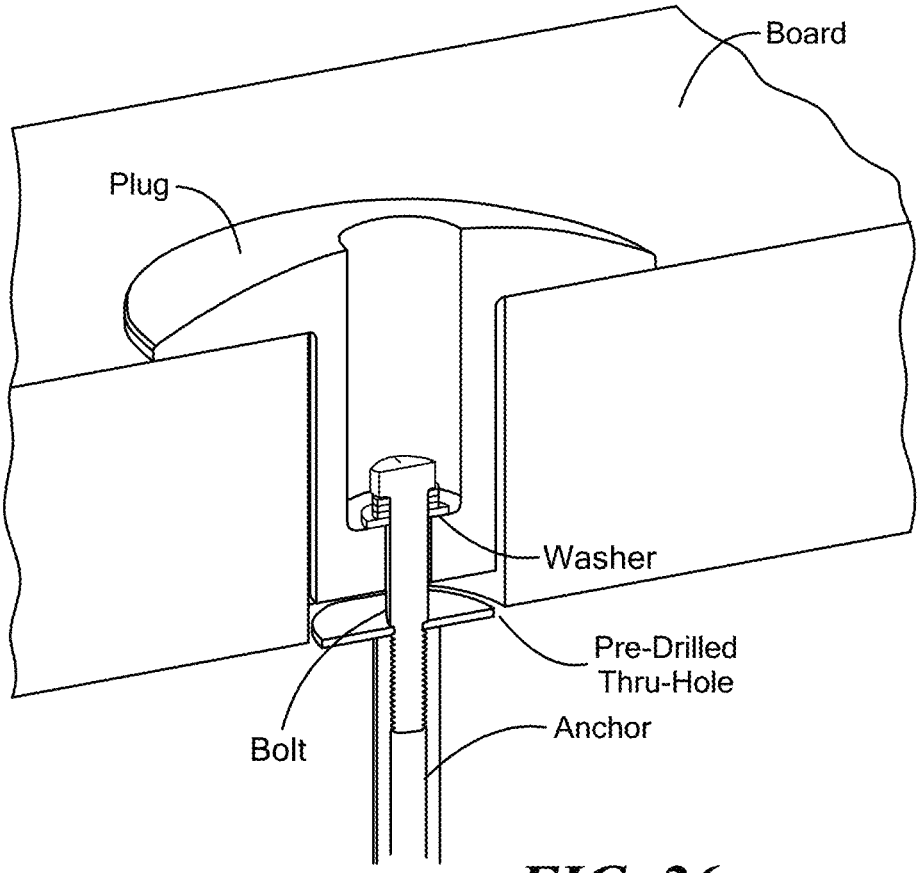
FIG. 26 is a further schematic cross-sectional illustration of an installed ground anchor.

At the site, the boards are laid in place. Spacers are placed between boards. The outer edges of the roundabout or splitter island are temporarily secured in place, for example, with boards. Installation holes are drilled into the ground through the holes in the boards using an appropriate drill guide (see FIG. 24), and the hole is cleaned out. The anchor cement is mixed and placed in the hole and the anchor is pushed into the hole (see FIG. 25). The bolt is removed from the anchor if still in the anchor. The plug is placed in the hole, and the bolt is replaced and tightened in place (see FIG. 26).

Field modifications can be readily made if necessary. For example, openings can be cut for manholes or water mains. Adjustments can be made for rutted roads or crowns. The boards can be cut using standard tools such as saws used for cutting wood.

As used herein, "consisting essentially of" allows the inclusion of materials or steps that do not materially affect the basic and novel characteristics of the claim. Any recitation herein of the term "comprising," particularly in a description of components of a composition or in a description of elements of a device, can be exchanged with "consisting essentially of" or "consisting of."

It will be appreciated that the various features of the embodiments described herein can be combined in a variety of ways. For example, a feature described in conjunction with one embodiment may be included in another embodiment even if not explicitly described in conjunction with that embodiment.

To the extent that the appended claims have been drafted without multiple dependencies, this has been done only to accommodate formal requirements in jurisdictions which do not allow such multiple dependencies. It should be noted that all possible combinations of features which would be implied by rendering the claims multiply dependent are explicitly envisaged and should be considered part of the invention.

The present invention has been described in conjunction with certain preferred embodiments. It is to be understood that the invention is not limited to the exact details of construction, operation, exact materials or embodiments shown and described, and that various modifications, substitutions of equivalents, alterations to the compositions, and other changes to the embodiments disclosed herein will be apparent to one of skill in the art.

What is claimed is:

1. A modular roundabout system for vehicular traffic, comprising:

a plurality of boards arranged in a pattern on a ground surface at an intersection of vehicle roadways, comprising:

a first perimeter portion of the plurality of the boards comprising perimeter boards arranged to form a perimeter of the pattern, at least some of the perimeter boards affixed to the ground surface, and a second interior portion of the plurality of the boards comprising interior boards arranged inwardly from the perimeter boards to form an interior of the pattern; and a plurality of connectors attached at adjacent edges of at least a portion of the interior boards to interconnect adjacent ones of the plurality of boards.

2. The modular roundabout system of claim 1, wherein the pattern includes a roundabout central island pattern or a splitter island pattern or both a roundabout central island pattern and a splitter island pattern.

3. The modular roundabout system of claim 1, wherein at least a portion of the boards have angled edges and at least a portion of the connectors are attached along the angled edges.

4. The modular roundabout system of claim 1, wherein each connector is formed of a urethane material.

5. The modular roundabout system of claim 1, wherein a rigid washer plate is fastened on top of each connector.

6. The modular roundabout system of claim 1, wherein the connectors have a shape chosen from a dog-bone shape, a rectangular shape, a square shape, a dovetail shape, a T-shape, and an I-shape.

7. The modular roundabout system of claim 1, wherein at least a further portion of the interior boards that are interconnected with the connectors are not affixed to the ground surface.

8. The modular roundabout system of claim 1, wherein at least a portion of the boards have weight-lightening features, the weight-lightening features comprising one or more of a beveled edge and a cut out region on a lower surface.

9. The modular roundabout system of claim 1, wherein each connector comprises a first portion connectable to a surface of a first board and a second portion connectable to a surface of a second board.

10. The modular roundabout system of claim 9, wherein the connectors are recessed into correspondingly shaped recesses formed in the surfaces of the boards.

11. The modular roundabout system of claim 9, wherein each connector includes a flexible hinge joint between the first portion and the second portion, wherein adjacent ones of the boards interconnected by the connector can be folded at the hinge joint.

12. The modular roundabout system of claim 11, wherein a plurality of the interior boards are interconnected together to form at least a section of the roundabout system, wherein the section of the interior boards can be folded or rolled at each hinge joint.

13. The modular roundabout system of claim 11, wherein each connector further includes a spacer depending from the hinge joint between each interior board and an adjacent board.

14. The modular roundabout system of claim 1, further comprising a plurality of ground anchors disposed to affix at least a portion of the boards to the ground surface, each ground anchor including:

an anchor cemented or grouted in a hole in the ground below an associated one of the boards, a bolt or screw extending through an opening in the associated board into the anchor, and a plug disposed within the opening in the associated board.

15. The modular roundabout system of claim 14, wherein each plug has a configuration chosen from a mushroom configuration, a wedge configuration disposed within a wedge-shaped opening, and a configuration disposed within a counterbore in the opening, and a configuration disposed with a countersink in the opening.

16. A method of making a roundabout, comprising:

providing the modular roundabout system of claim 1; and installing the boards in the pattern on the ground surface at the intersection of vehicle roadways.

17. The method of claim 16, wherein:

the step of providing the modular roundabout system includes interconnecting at least a portion of the interior boards together via ones of the connectors to form at least a section of the roundabout system, and rolling the section up for transportation; and the step of installing the boards in the pattern on the ground surface includes unrolling the section on the ground surface.

18. The method of claim 16, wherein:

the step of interconnecting the interior boards together includes interconnecting radially adjacent interior boards with the connectors; and the step of installing the boards in the pattern on the ground surface includes interconnecting circumferentially adjacent interior boards with the connectors.

19. The method of claim 16, further comprising affixing a further portion of the interior boards to the ground surface with ground anchors, wherein the further portion is less than all of the interior boards.

20. A modular roundabout or traffic calming kit comprising:

a plurality of boards configured to be disposed in a pattern on a ground surface at an intersection of vehicle roadways, comprising:

a first perimeter portion of the plurality of the boards comprising perimeter boards configured to form a perimeter of the pattern, at least some of the perimeter boards affixable to the ground surface, and a second interior portion of the plurality of the boards comprising interior boards configured to form an interior of the pattern;

a plurality of connectors attachable to edges of at least a portion of the interior boards to interconnect adjacent ones of the interior boards; and a plurality of ground anchors to affix at least some of the perimeter boards to the ground surface.

* * * * *